US012622476B2

(12) United States Patent
Morris et al.

(10) Patent No.: US 12,622,476 B2
(45) Date of Patent: May 12, 2026

(54) TRESSES FOR CUSTOM HAIR EXTENSIONS AND SYSTEMS AND METHODS FOR CREATING AND ATTACHING CUSTOM HAIR EXTENSIONS

(71) Applicant: Glamlocks Corporation, Del Mar, CA (US)

(72) Inventors: Autumn Morris, Del Mar, CA (US); Waatani Norris, Del Mar, CA (US)

(73) Assignee: Glamlocks Corporation, Del Mar, CA (US)

( * ) Notice: Subject to any disclaimer, the term of this patent is extended or adjusted under 35 U.S.C. 154(b) by 290 days.

(21) Appl. No.: 18/463,120

(22) Filed: Sep. 7, 2023

(65) Prior Publication Data

US 2025/0082056 A1 Mar. 13, 2025

(51) Int. Cl.
*A41G 5/00* (2006.01)

(52) U.S. Cl.
CPC ..... *A41G 5/0046* (2013.01); *A41G 5/006* (2013.01)

(58) Field of Classification Search
CPC ..... A41G 5/00; A41G 5/0006; A41G 5/0013; A41G 5/0033; A41G 5/004; A41G 5/0053; A41G 5/006; A41G 5/0073; A41G 5/008; A41G 3/00; A41G 3/0008; A41G 3/0025; A41G 3/0033; A41G 3/0041; A41G 3/005; A41G 3/0066
See application file for complete search history.

(56) References Cited

U.S. PATENT DOCUMENTS

2002/0166565 A1* 11/2002 Whitfield ..... A41G 3/0016 132/54
2002/0179108 A1* 12/2002 Harrison ..... A41G 3/00 2/209.13
2010/0170523 A1* 7/2010 DePalma ..... A41G 3/0041 132/54
2011/0023903 A1* 2/2011 Kezios ..... A41G 3/005 132/54

(Continued)

FOREIGN PATENT DOCUMENTS

JP 3225279 U * 2/2020

OTHER PUBLICATIONS

JP3225279U (Year: 2020).*

*Primary Examiner* — Rachel R Steitz
*Assistant Examiner* — Karim Asqiriba
(74) *Attorney, Agent, or Firm* — TechLaw Ventures, PLLC; Bretton L. Crockett

(57) ABSTRACT

This disclosure extends to systems, apparatus, and methods related to the creation of customized hair extensions. Systems in accordance with this disclosure may include unique tresses for creating custom hair extensions. These multi-purpose designs enable the tress to be used for different hair extension styles easily and quickly in any style and then easily attach the custom hair extensions for wear. These unique tress designs may allow for attachment to the user's hair in multiple ways. The uppermost slat may be configured for seamless sew-in attachment, a series of connection holes may be positioned for attachment to user's hair pulled therethrough by beaded or tube attachment, with upper holes allowing for a halo-style attachment, and parallel rows of slots allow for hair integration to provide attachment to the user's natural hair, with the blending of the attached wefts with the user's natural hair.

7 Claims, 6 Drawing Sheets

(56) References Cited

U.S. PATENT DOCUMENTS

| | | | | |
|---|---|---|---|---|
| 2012/0234338 | A1* | 9/2012 | Verbonac | A41G 5/008<br>132/201 |
| 2018/0220727 | A1* | 8/2018 | Kasper | A41G 5/0073 |
| 2020/0146379 | A1* | 5/2020 | Sonoyama | A41G 3/0066 |
| 2022/0408866 | A1* | 12/2022 | Morris | A41G 5/0073 |

* cited by examiner

TRESSES FOR CUSTOM HAIR EXTENSIONS AND SYSTEMS AND METHODS FOR CREATING AND ATTACHING CUSTOM HAIR EXTENSIONS

BACKGROUND

This disclosure relates generally to methods, systems, and devices for creating and using hair extensions.

Systems for creating hair extensions are known in the art. Such known systems are typically designed for attached one or more hair wefts to the existing hair of a wearer, using a particular form of attachment. Different systems are selected based on the wearer's existing hair or the desired weft to used. However, such systems typically lack the flexibility to utilize different attachment methods and to connect to a variety of different hair wefts. A system including a base member that allows for the creation of custom hair extensions that can be attached for use in different manners would be an improvement in the art.

SUMMARY

This disclosure extends to systems, apparatus, and methods related to the creation of customized hair extensions.

In some embodiments, systems in accordance with the principles of this disclosure may include unique tresses that enable users to create custom hair extensions that can be utilized for different hair styles and techniques. Such a tress may facilitate the creation of different hair extension types such as sew-in hair extensions, tape-on hair extensions, halo hair extensions, clip-in hair extensions, ponytail clip-in hair extensions, beaded weft hair extensions, or beaded hair tress hair extensions. These multi-purpose tress designs enable the tress to be used for different hair extension style allowing users to easily and quickly make their own hair extensions in any style and then easily attach the custom hair extensions onto their heads or other users.

In one illustrative embodiment, such a tress, or base member is formed of a flexible material and has opposite first and second sides. The tress may have a symmetrical shape when laid flat. In some illustrative embodiments, the tress may have a polygonal shape with a first, or upper, end and a second, or lower, end that are parallel to one another towards opposite side ends. In one embodiment, the tress may be formed in a generally rectangular shaped upper portion and a generally rectangular shaped lower portion, with the lower portion inset such that the first end may extend further out from a midpoint than the lower end towards the opposite side ends.

The tress may include parallel rows of slats separated by parallel rows of slots, with the slats connected by stabilizing bars that define ends of the slots. The side ends of the lower portions may align with two of the stabilizing bars. The lower edges and side edges may have an increased width and a series of holes may be disposed in the lower edges and side edges for connection use. A first side of the tress may include an adhesive that is disposed across the slats to define parallel rows of adhesive strips, with a series of sealing strips covering the adhesive until selected for use.

The parallel rows of adhesive strips may be disposed across the first side of the tress so that multiple hair wefts can be easily attached thereto. The holes on the side edges may be positioned to allow a hair weft to be attached to a slate therebetween without trimming. The parallel positioning of the plurality of adhesive strips allows multiple hair wefts can be overlapped while being attached onto a corresponding strip from the plurality of adhesive strips. In addition, the plurality of adhesive strips may allow multiple hair wefts to be attached that are be spread out across the tress. Thus, the user can create a desired hair extension by adhering hair wefts to the tress without the need of fasteners or other tools.

The illustrative tress may allow for attachment to the user's hair in multiple ways. The uppermost slat may be configured for seamless sew-in attachment to a weaving base, the series of holes may be positioned for attachment to user's hair pulled therethrough without buckling by beaded or tube attachment, with upper holes allowing for a halo-style attachment. Finally, the parallel rows of slots allow for hair integration to provide both attachment to the user's natural hair, with the blending of the attached wefts and the user's natural hair for a natural looking appearance.

The present disclosure further includes the processes and methods of creating and applying hair extension systems. In illustrative embodiments, a user may create a custom hair system by selecting one or more desired weft. A tress in accordance with the present disclosure may be laid on a non-slip surface. The lowest slat desired for use may have the sealing strip removed and the weft adhered to the slat along its hair arrangement band. Extra securement may be obtained by squeezing the weft band to the tress with a tool and/or applying heat. Additional wefts may be secured to the tress along desired other slats moving in an upwards manner. Once complete, the system may be installed for wear using one or more techniques. For example, installation may include the use of the sewn-in technique where the uppermost slat and the hair arrangement band of weft secured thereto are "sewn in" to a wearer's natural hair. The wearer's hair may be pulled though the surrounding holes for securing using beads or tubes. The wearer's hair may be integrated through the system by individually lifting the wefts out of the way sliding the user's hair through the slots. Additionally, the surrounding holes may be used to secure a halo for securing to the head of wearer.

The features and advantages of the disclosure will be set forth in the description, which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like, which has been included in the specification is not to be taken as an admission that any or all these matters form part of the prior art base, or were common general knowledge in the field relevant to the disclosure as it existed before the priority date of each claim of this disclosure.

DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure extends to methods, systems, and devices for hair extension systems that may be customized for, and securely attached to the hair of wearer. In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems and devices of the present disclosure are discussed and described, it is to be understood that this disclosure is not limited to the particular configurations, process steps, and materials disclosed herein as such configurations, process steps, and materials may vary somewhat. It is also to be understood that the terminology employed herein is used for the purpose of describing implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

It will be appreciated that the term "tube" as used herein may mean a shrink tube that secures hair therein after heat or pressure is applied thereto, or another hair securing tube as is known to those of skill in the art. Similarly, the term "bead" includes both plain beads and lined beads, such as silicone lined beads.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

Figure 1A:
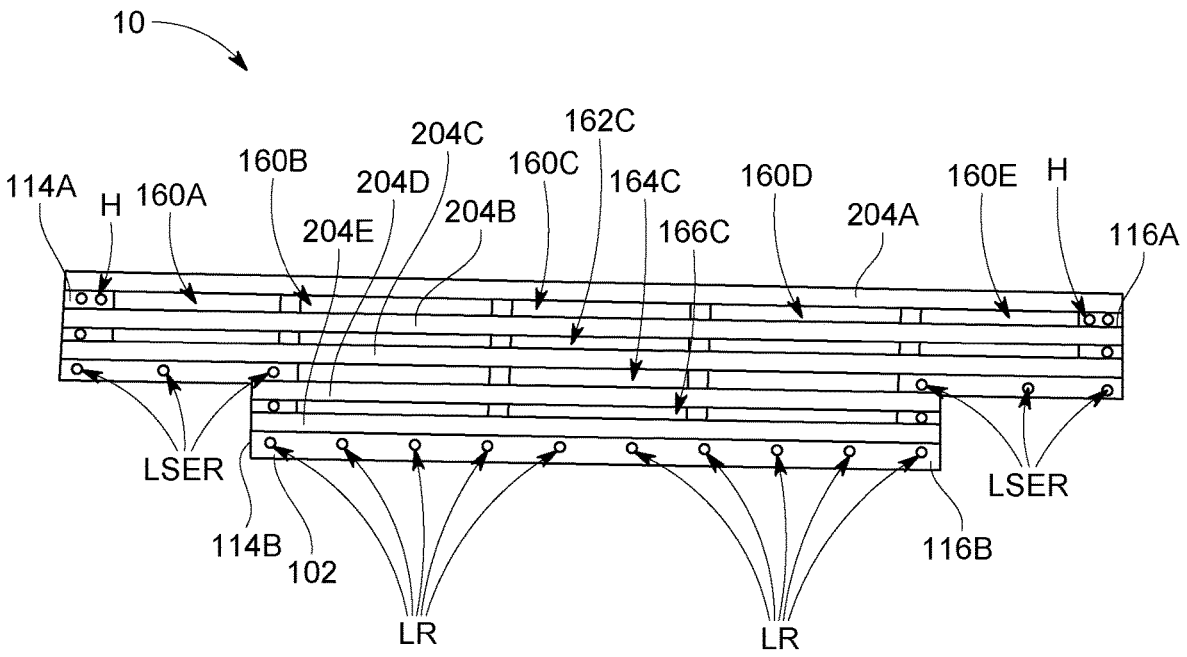
FIGS. 1A and 1B illustrates a front and rear views, respectively, of a tress assembly for use in a system in accordance with the present disclosure.
Figure 1B:
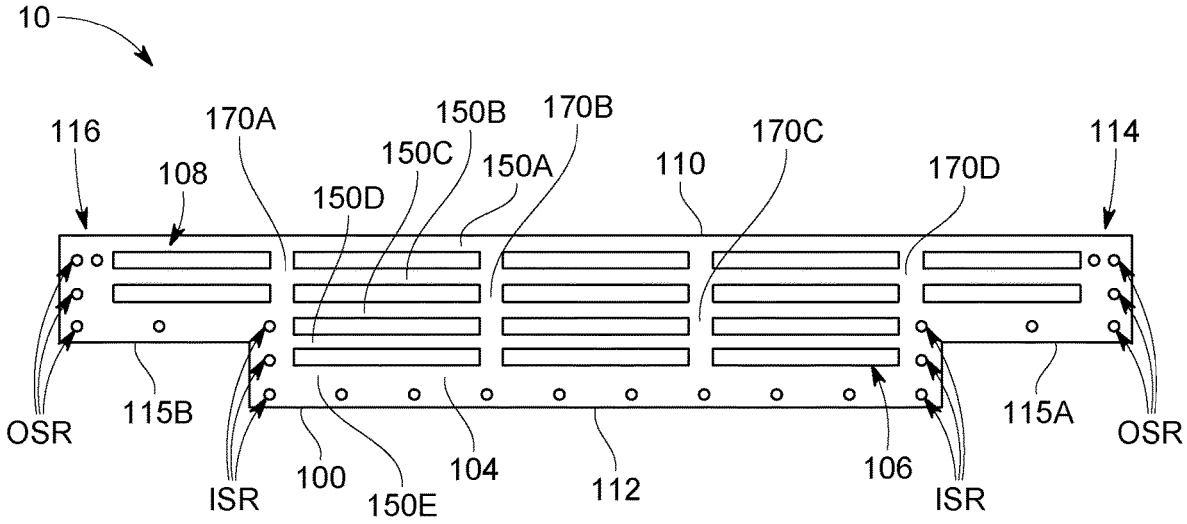

A first example of an embodiment of a unique tress 10 in accordance with the principles of the present disclosure that enables a user to create custom hair extensions that can be utilized for different hair styles and techniques is depicted in FIGS. 1A and 1B. Such a tress 10 may facilitate the creation of different hair extension types such as sew-in hair extensions, tape-on hair extensions, halo hair extensions, clip-in hair extensions, ponytail clip-in hair extensions, beaded weft hair extensions, or beaded hair tress hair extensions. These multi-purpose tress designs enable the tress to be used for different hair extension style allowing users to easily and quickly make their own hair extensions in any style and then easily attach the custom hair extensions onto their heads or other users'.

In the depicted illustrative embodiment, tress 10 may include a base member, or body 100, which may be formed of a flexible material and have opposite first and second sides, such as front side 102 and rear side 104. In some embodiments, the tress body 100 may be formed from a single layer of PVC material to form a waterproof, lightweight body that is flexible, durable and paper thin. It will be appreciated that for particular applications, the tress 10 may be formed from other materials that are suitable for use as a hair weave base that have suitable properties for a particular application.

Tress 10 may have a symmetrical shape when laid flat. In some illustrative embodiments, the tress body 100 may have a polygonal shape with a first, or upper, end 110 and a second, or lower, end 112 that are parallel to one another towards opposite side ends 114 and 116. In one embodiment, the tress may be formed with a generally rectangular shaped upper portion 106 and a generally rectangular shaped lower portion 108, with the lower portion 108 inset such that the first end 100 may extend further out from a midpoint to its side ends 114A and 116A than the lower end 112 towards is respective opposite side ends 114B and 116B.

The tress body 100 may be defined by parallel rows of slats (as indicated at 150A, 150B, 150C, 150D and 150E) that are separated by parallel rows of slots (as indicated at first sow, 160A, 160B, 160C, 160D and 160A and parallel rows 162C, 164C, and 166C) with the slats connected by stabilizing bars (as indicated at 170A, 170B, 170C and 170D, that may that define ends of the slots (see e.g., 162C). In the depicted illustrative embodiment, the side ends 114B and 116B of the lower portion 108 may align or be continuous with two of the stabilizing bars (170A and 170D). The lower edges may be formed as slats having an increased width and the side edges may be formed as stabilizing bars having an increased width. The increased widths of lower edges and side edges allows for increased strength and provides for a series of holes that may be disposed in the lower edges and side edges for connection use, as will be discussed further herein.

The front side 102 of the tress body 100 may include an adhesive that is disposed across the slats to define parallel rows of adhesive strips (202, FIG. 2), with a series of sealing strips (204A, 204B, 204C, 204D and 204E) covering the adhesive until selected for use. It will be appreciated that while the depicted embodiment has five rows of slats depicted by four rows of parallel slots, that variations from the depicted design are contemplated. For example, embodiments with pluralities of aligned slats and separating slots having different number may be used.

The parallel rows of adhesive strips may be disposed across the first side of the tress so that multiple hair wefts can be easily attached thereto. Each slat and the adhesive strip formed thereon may be sized to correspond to the weaving base of a hair weft that may be used as part of systems in accordance with the present disclosure. The parallel positioning of the plurality of adhesive strips allows multiple hair wefts to be overlapped while being attached onto corresponding parallel strips of the plurality of adhesive strips. In addition, the plurality of adhesive strips allows multiple hair wefts to be attached that are be spread out across the tress. Where the tress 10 and wefts are sold for use as a system in accordance with the present disclosure, the length of tress body and the length of the hair weave base of the wefts may be correspond to one another to allow for use without requiring trimming of the wefts and/or the tress body. For example, upper portion 106 may correspond to the length of three wefts and lower portion 108 may correspond to the length of two wefts. In other embodiments, the holes on the side edges of a section may be positioned to allow a single hair weft to be attached to a slate therebetween without trimming. For example, the upper section 106 could include four slats, each allowing a single tress to be secured thereto between the connection holes on either side. In another embodiment, the lower section 108 could include a number of slats, each allowing a single tress to be secured thereto between the connection holes on either side, and upper section 108 could include slats sized to allow two tresses to be secured side by side thereto between the connection holes on either side. In some embodiments, a system could include separate tresses sized to correspond individual slats of the tress.

It will be appreciated that the parallel adhesive strips may be formed by depositing a suitable adhesive on the slats. Some suitable adhesives may include a double-sided adhesive tape, gel or liquid adhesives that are deposited on the slats and allowed to cure. In some embodiments, where a suitable adhesive is selected, a user can create a desired hair extension by adhering hair wefts to the tress without the need of fasteners or other tools. In other embodiments, the adhesive may be used to secure the wefts to the respective slats by the use of pressure or heat.

The side ends 114A, 114B, 116A, and 116B and lower end may be wider than the slats 150A, et seq. to allow for the placement of holes for connecting the tress to a wearer's hair. In one illustrative embodiment, the overall height of the tress body 100 from lower end 112 to upper end 110 may be about 53 mm, with side ends 114A and 116A of upper portion 106 having a length of about 32 mm and side ends 114B and 116B of lower portion 108 having a length of about 21 mm. Upper side 110 and upper portion 106 may have a width of about 302 mm between side ends 114A and 116A, and lower side 112 and lower portion 108 may have a width of about 200 mm between side ends 114B and 116B. Each side edge 114B or 116B of lower portion 106 may be inset by about 55 mm from the corresponding side edge 114A or 116A of upper portion. Slats 150B, 150C, 150D and 150E may each have a height of about 6 mm and the slots may each have a height of about 4 mm. The plurality of stabilizing bars may extend from the bottom edge to the top edge to define end points for the slots and provide connection and reinforcement to the slats. In the depicted embodiment, there are four stabilizing bars 170A, 170B and 170D, which may be equally spaced apart from each other and each have a width of about 4 mm.

Side edges 114A, 114B, 116A, and 116B may each have a respective width of about 14 mm extending into the body 100. The lower edge 112 and the lower side edges 115A and 115B of the upper section 106 adjacent to the insets may each have a respective height of about 12 mm extending into the body 100. The side edges may be formed as stabilizing bars with an increased width.

A number of connection holes may be formed in the body 100 along the lower edges and side edges of the tress body. In the depicted embodiment, each of these connection holes may be formed as circle having a diameter of about 3.5 mm. Along the lower side edge a row of connection holes CH (FIG. 2), generally indicated at LR may be disposed. In the depicted embodiment, row LR may include ten connection holes CH in a line, with each placed about 4 mm from the lower edge of body 100. The two outer holes may be inset by about 4.5 mm from the respective side edges and about 17 mm between each of the CH hole and the adjacent CH hole in the line LR. On each lower side edge 114B and 116B, two additional connection holes CH may be placed between the slats, vertically aligned in a row ISR with the lower outer hole of line ISR being the outer member of row LR near the bottom edge.

The uppermost connection holes CH in row ISR may be disposed adjacent the lower side edges 115A and 115B of the upper section 106 adjacent to the insets and may be aligned with holes disposed across the body on its the respective lower side edge 115A or 115B to form a row of connection holes LSER along the lower side edge, which may be inset about 2.5 mm from the lower side edge. On each upper side edge 114A and 116A, two additional connection holes CH may be placed disposed, vertically aligned in a row OSR with the lower hole of line OSR being the outer member of row LSER near the lower side edge. In the depicted embodiment, the connection holes CH of the outer side edge row OSR may be inset about 3.5 mmm from the upper side edge. One each edge, an additional "halo" connection hole H may be disposed aligned with the uppermost connection hole of row OSR inset about an additional 2.0 mm towards the center of body 100.

An aligned row of connection holes on each lower side edge 115A and 115B connection holes may be spaced about 20 mm apart with the outer connection hole disposed about 3.5 mm from the respective outer side edge 114A or 116A.

In the depicted embodiment, a vertically aligned set of three connection holes may be disposed near the outer edges 114A and 116A of the upper portion 106, with the outermost hole of the lower side edge aligned set of holes being the lower member of the vertically aligned connection holes.

The increased width of the side edges and lower edges compared to the stabilizing bars and slats may provide additional strength to the body 100, allowing for the connection holes to be used in securing the tress for use while reducing or minimizing tearing of the material from which body 100 is formed.

Body 100 may be formed by any suitable method, including cutting a suitable substrate, as with a cutting die, to create the desired shape with the slats, slots, stabilizing bars and connection holes, by injection molding using a suitable material or as may otherwise be known in the art. Once the body 100 is created, a suitable adhesive and sealing strips may then be disposed on the front surface 102.

Tresses in accordance with the present disclosure tress may allow for attachment to the user's hair in multiple ways. The uppermost slat 150A may be configured for seamless sew-in attachment to a weaving base, the series of connection holes CH may be positioned for attachment to user's hair pulled therethrough without buckling by beaded or tube attachment, with upper holes allowing for a halo-style attachment. Finally, the parallel rows of slots allow for hair integration to provide both attachment to the user's natural hair, with the blending of the attached wefts and the user's natural hair for a natural looking appearance.

Figure 2:
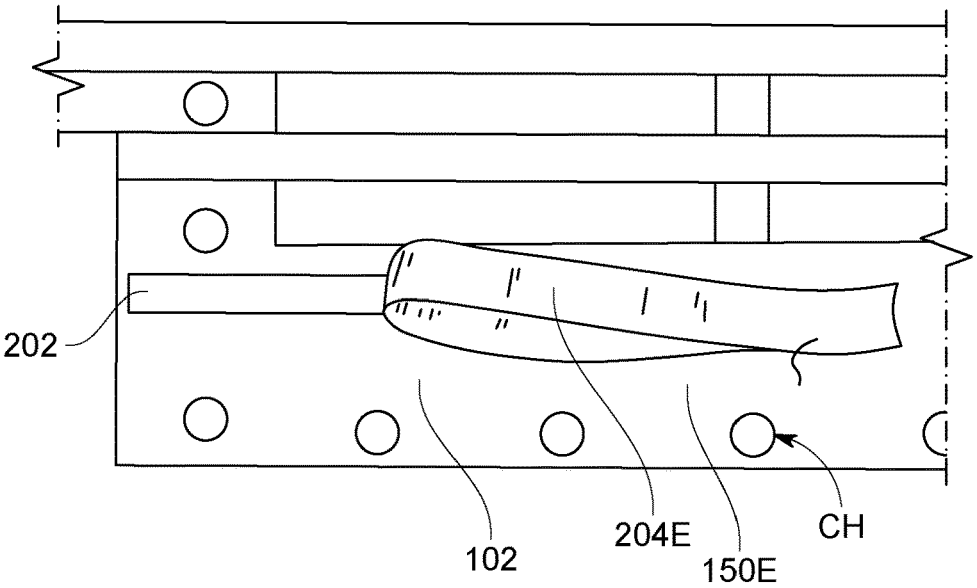
FIG. 2 illustrates an enlarged view of a portion of the assembly of FIGS. 1A and 1B.

Turning to FIGS. 2 through 6, some portions of processes and methods of creating and applying hair extension systems in accordance with the present disclosure are illustrated. In illustrative embodiments, a user may create a custom hair system by selecting one or more desired wefts. A tress 10 in accordance with the present disclosure may be readied, which could include laying the tress 10 on a non-slip surface. The lowest slat desired for use may have the sealing strip removed, as illustrated in FIG. 2 with slat 150E, where sealing strip 204E is being removed by pulling to expose adhesive strip 202.

Figure 3:
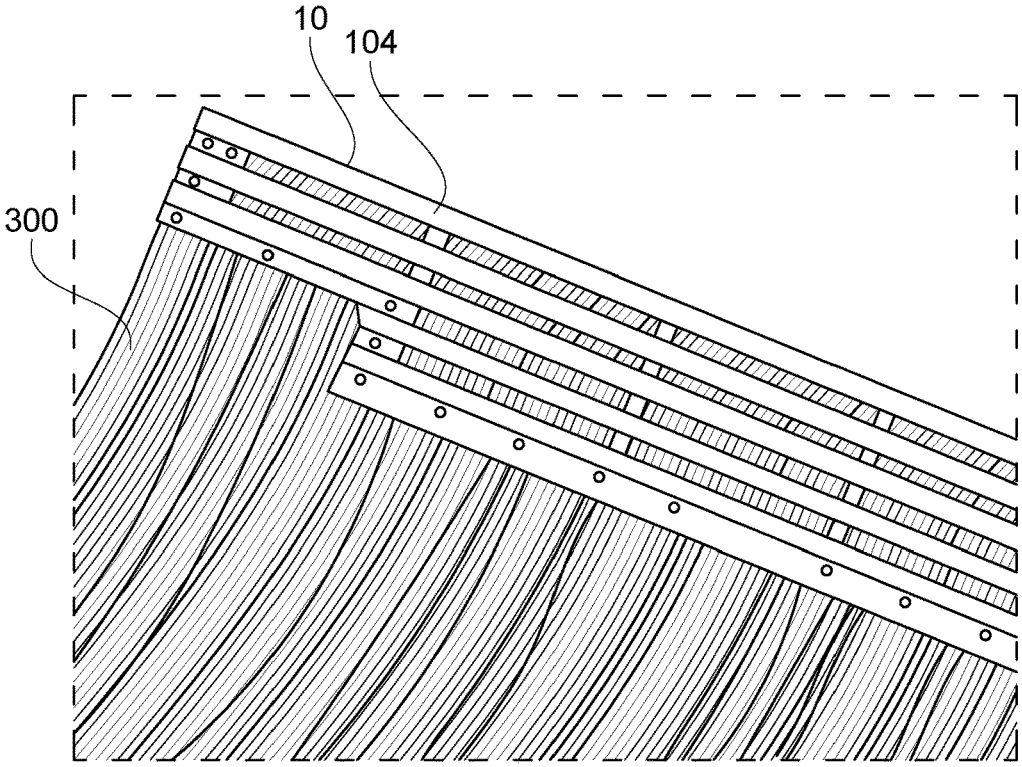
FIG. 3 illustrates a rear perspective view of the assembly of FIGS. 1A-2 with a one or more wefts attached thereto and 1B.
Figure 4:
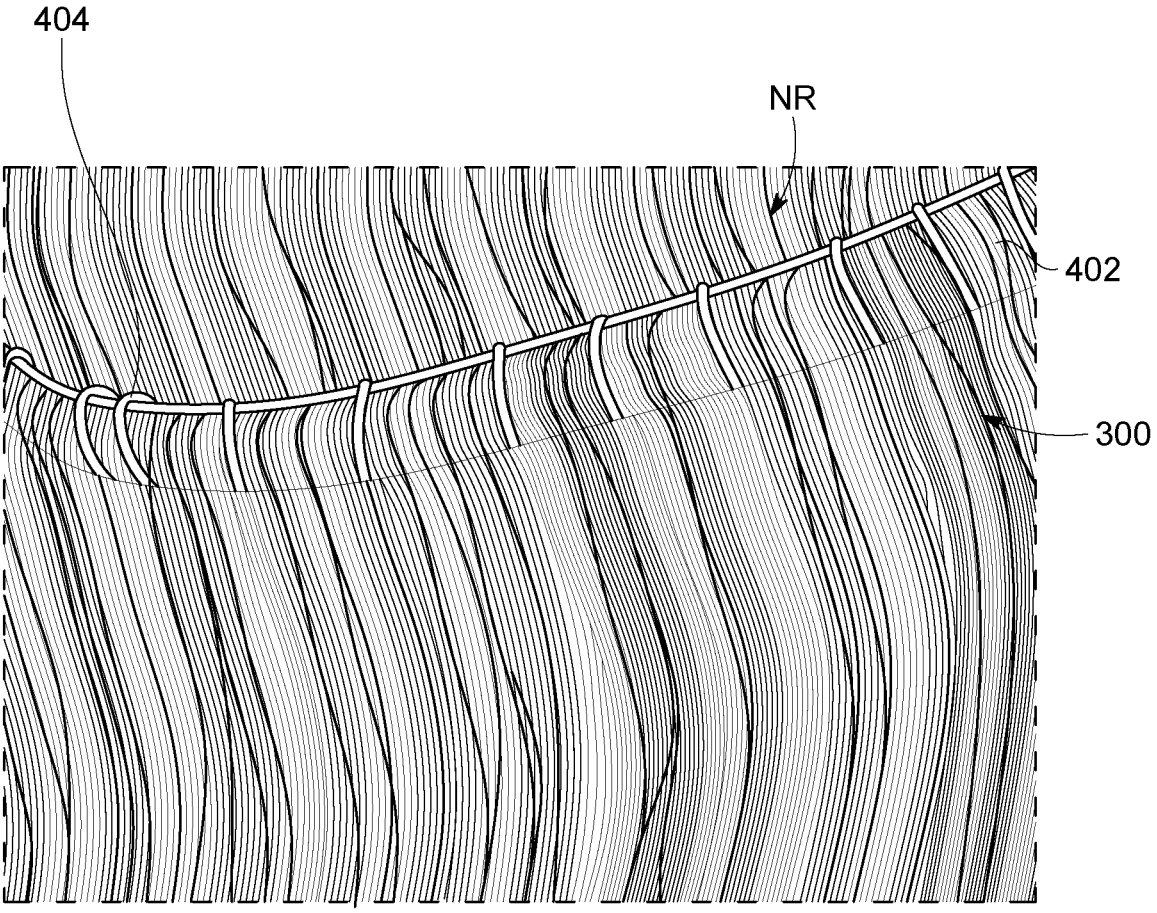
FIG. 4 illustrates an enlarged view of a portion of the assembly of FIGS. 1A through 3 attached to the hair of a wearer.

A weft 300 may then be adhered to sealing strip 202 with the weft adhered to the slat along its hair arrangement band 402 (FIG. 4). Where necessary or desired, extra securement may be obtained by squeezing the weft band to the tress with a tool and/or applying heat to activate the adhesive. Additional wefts may be secured to the tress along desired other slats moving in an upwards manner to create a hair extension system ready for installation as depicted in FIG. 3.

Once complete, the system may be installed for wear using one or more techniques. One such technique is depicted in FIG. 4, where the uppermost slat 150A and the hair arrangement band 402 of weft 300 secured to the slat 150A are "sewn in" to a wearer's natural hair NR using a suitable cord 404.

Figure 5:
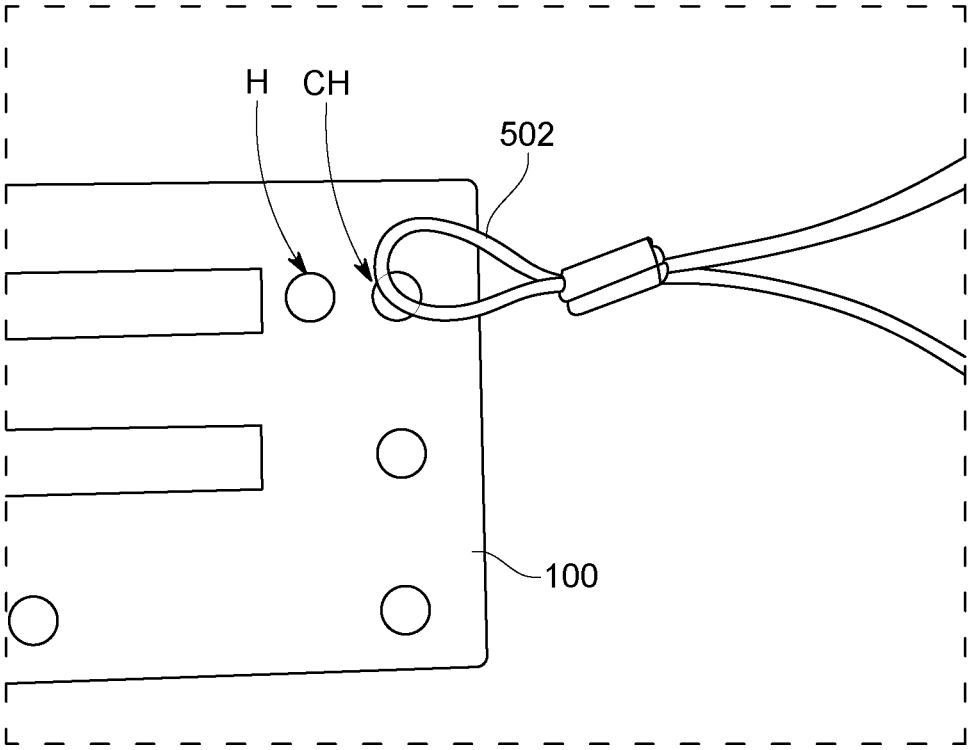
FIG. 5 illustrates an enlarged view of a portion of the assembly of FIGS. 1A through 4 showing the connections for another method for attachment to the hair of a wearer.

Additionally, the wearer's hair may be pulled though the connection holes CH in the rows LR, ISR, LSER and OSR, and then beads or shrink tubes applied to the hair to secure the tress 10 thereon. The spacing between the connection holes CH may ensure that the tress retains a smooth appearance by preventing "buckling." Connection holes including those in OSR and the "halo holes" H may be used to secure a halo cord HC for securing to the head of wearer. FIG. 5 depicts a halo cord 502 adjacent these connection holes in preparation for such a connection.

Figure 6:
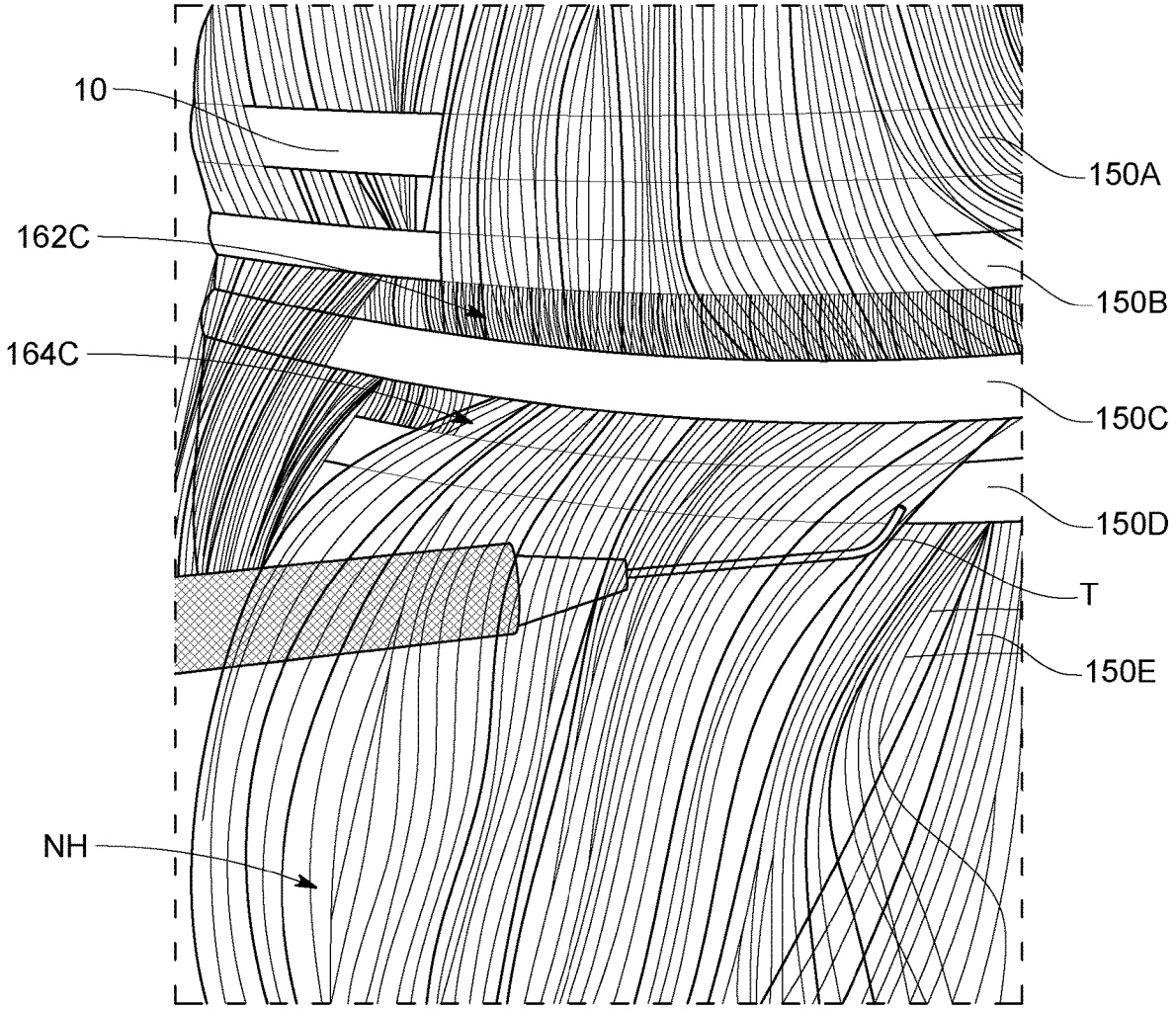
FIG. 6 illustrates an enlarged view of a portion of the assembly of FIGS. 1A through 5 showing part of a method of attachment to the hair of a wearer.

As depicted in FIG. 6, tress 10 may allow for a hair integration attachment. As depicted, the system may be held in the desired place temporarily as by clips. The wearer's hair may then be integrated through the system by individually lifting the wefts out of the way and sliding the wearer's natural hair NH through the slots 162C and 164C using a suitable tool T. Shrink tubes or beads may then be placed on the wearer's head to prevent it from passing back through the slots.

Figure 7A:
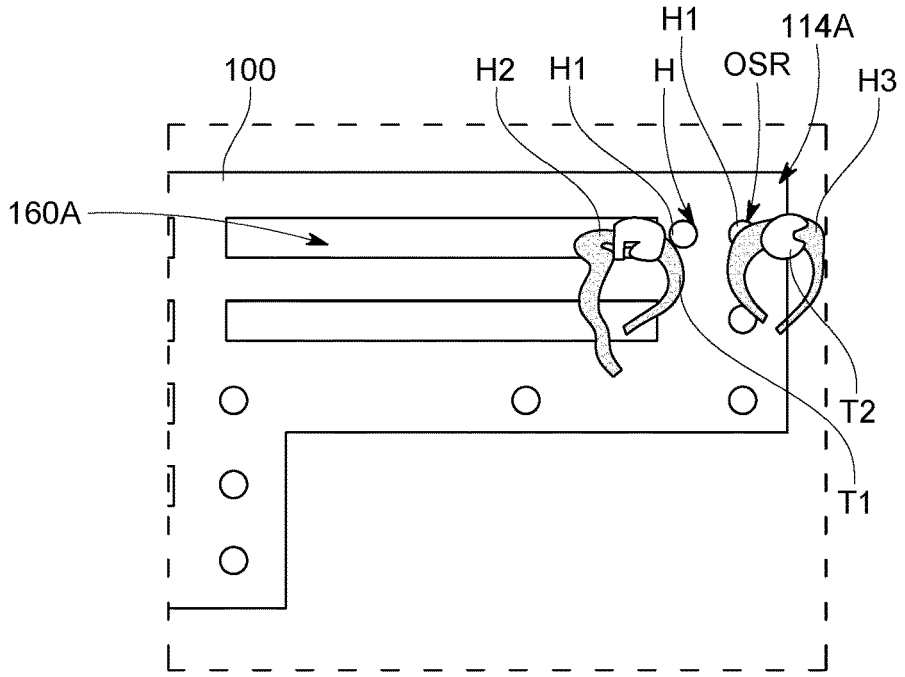
FIGS. 7A and 7B illustrate enlarged view a of a portion of the assembly of FIGS. 1A through 6 showing parts of methods of attachment to the hair of a wearer.

Turning to FIG. 7A, one method of using connection holes H and OSR in the upper side edge 114A to attached to the hair of wearer while reducing the tendency of the body 100 to wrinkle or buckle during use is depicted. A small section H1 of the wearer's hair is pulled through the holes H and the topmost aligned OSR. Another small section H2 of the wearer's hair is pulled from inside the body 100 through slot 160A. Sections H1 and H2 are then secured to one another with a first bead or tube T1 between the hole H and the slot 160A. Similarly, a small section H3 of the wearer's hair is pulled from outside the body 100 and sections H1 and H3 are then secured to one another with a second bead or tube T2 between the topmost OSR connection hole and the edge of the body 100.

Figure 7B:
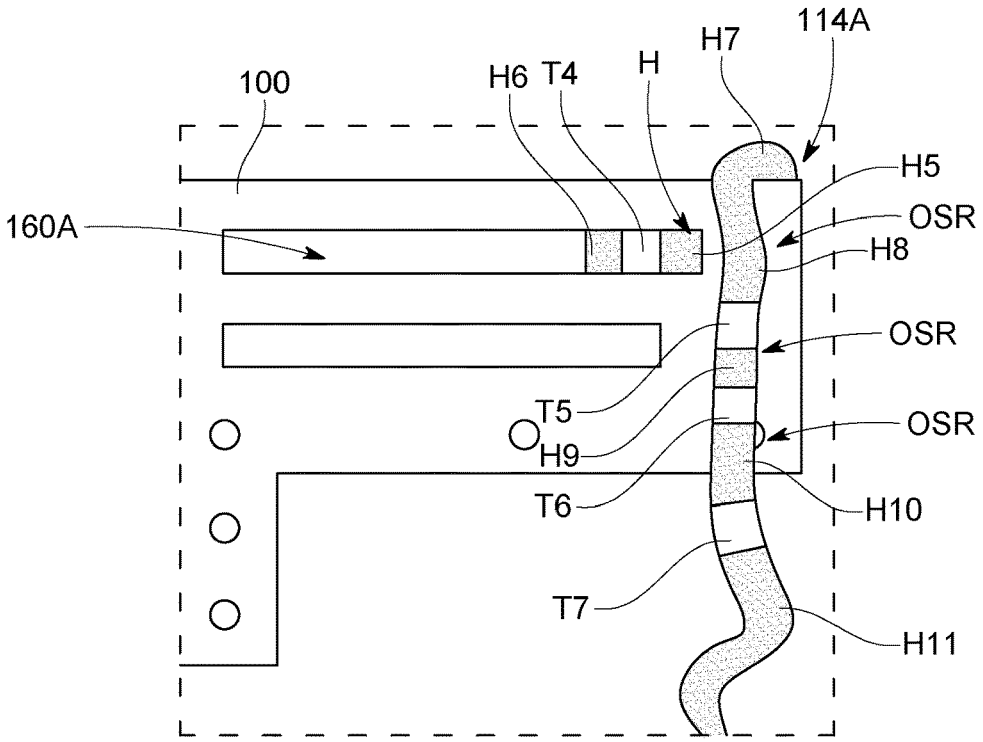

Another method of using connection holes H and OSR in the upper side edge 114A to attached to the hair of wearer while reducing the tendency of the body 100 to wrinkle or buckle during use is depicted in FIG. 7B. A small section H5 of the wearer's hair is pulled through the connection hole H and the topmost aligned OSR. Another small section H6 of the wearer's hair is pulled from inside the body 100 through slot 160A. Sections H5 and H6 are then secured to one another with a first bead or tube T4 between the hole H and the slot 160A. A strand H7 of the of the wearer's hair is pulled from above the body 100, strands H8, H9 and H10 are pulled through the three OSR connection holes and strand H11 is pulled from below the body 100. These sections of hair are then secured to one another with beads or tubes T5 and T6 between the two lower OSR connection holes and by bead or tube T7 between the lowermost connection hole and the lower the edge of the body 100 side edge 114A.

It will be appreciated that similar connections may be made using the reaming connection holes and that such connections can help prevent tension hair loss due to the weight of the tresses in an assembled system.

One advantage of systems in accordance with the present disclosure is that multiple attachment methods may be used with the tress 10 at the same time without requiring modifications to the tress or the use of add-ons such as clips and combs. For example, the tress may use sew-in, hair integration, beaded connection holes and/or halo connections in any combination as may be useful for a particular hair extension or the natural hair present on a user's head.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A system for creating custom hair extension, the system comprising:

a tress, wherein the tress comprises a generally planar body formed of a flexible material and having a front surface and an opposite back surface, the body further comprising a plurality of aligned members forming a plurality of slats that extend across a width of the body, the slats of the plurality of slats separated from one another by a series of parallel slots, a plurality of stabilizing bars disposed at a generally orthogonal angle to the plurality of slats, the plurality of stabilizing bars connecting the plurality of slats to one another and defining ends of the slots of the series of parallel slots;

a plurality of connection holes disposed in the body, the plurality of connection holes passing through portions of the body from the front surface to the back surface;

a plurality of adhesive strips, comprising an adhesive strip formed on each of the plurality of slats;

a plurality of sealing strips covering the plurality of adhesive strips, each sealing strip covering the adhesive strip and configured for releasable removal therefrom to expose the adhesive strip for use;

wherein a lower side of the tress body is defined by a lowermost slat, which has an increased width compared to the other slats of the plurality of slats, and a portion of the plurality of connection holes are disposed in the lowermost slat; and wherein the adhesive strip disposed on the lowermost slat has a width corresponding to the height of the weft attachment band and the plurality of connection holes disposed in the lowermost slat are disposed below the adhesive strip.

2. The system of claim 1, further comprising at least one hair weft, the at least one hair weft comprising a weft attachment band and weft hair extending from the weft attachment band, wherein the weft attachment band has a height that corresponds to the height of the slat of the plurality of slats.

3. The system of claim 1, wherein the tress comprises the body with an upper portion and a lower portion, wherein the upper portion is comprised of plurality of slats having a first width, and the lower portion is comprised of plurality of slats having a second width which is less than the first width.

4. The system of claim 1, wherein left and rights sides of the tress body are defined by end stabilizing bars that have an increased width compared to the other stabilizing bars of the plurality of stabilizing bars, and a portion of the plurality of connection holes are disposed in the end stabilizing bars.

5. The system of claim 1, wherein the adhesive strip is formed by two-sided adhesive tape.

6. The system of claim 1, wherein the plurality of slats comprises five slats.

7. The system of claim 1, wherein the plurality of stabilizing bars comprises six stabilizing bars.

* * * * *